US005743129A

United States Patent [19]

Chubb et al.

[11] Patent Number: 5,743,129

[45] Date of Patent: *Apr. 28, 1998

[54] HEAVY DUTY SHEET BENDING BRAKE

[75] Inventors: Arthur B. Chubb, Romulus; James E. Suyak, Lincoln Park, both of Mich.

[73] Assignee: Tapco International Corporation, Plymouth, Mich.

[ * ] Notice: The term of this patent shall not extend beyond the expiration date of Pat. No. 5,582,055.

[21] Appl. No.: 756,608

[22] Filed: Nov. 26, 1996

Related U.S. Application Data

[63] Continuation-in-part of Ser. No. 268,808, Jun. 30, 1994, Pat. No. 5,582,055, which is a continuation of Ser. No. 987,249, Dec. 7, 1992, Pat. No. 5,343,728, which is a continuation of Ser. No. 798,207, Nov. 26, 1991, abandoned.

[51] Int. Cl.[6] ..... B21D 5/04

[52] U.S. Cl. ..... 72/319; 72/455; 248/676

[58] Field of Search ..... 72/319, 323, 149, 72/159, 217, 455; 248/676, 677, 678, 165, 910; 269/901

[56] References Cited

U.S. PATENT DOCUMENTS

| | | | |
|---|---|---|---|
| 131,239 | 9/1872 | Adler . | |
| 934,701 | 9/1909 | Swanson | 72/455 |
| 2,181,566 | 11/1939 | Jensen | 72/319 |
| 2,343,441 | 3/1944 | Babcock | 72/319 |
| 2,434,028 | 1/1948 | Wieland . | |
| 3,481,174 | 12/1969 | Barnack | 72/319 |
| 3,482,427 | 12/1969 | Barnack | 72/319 |
| 4,223,881 | 9/1980 | Hickman | 269/901 |
| 4,372,142 | 2/1983 | Rhoades | 72/319 |
| 4,494,397 | 1/1985 | Rhoades . | |
| 4,557,132 | 12/1985 | Break | 72/319 |
| 4,713,957 | 12/1987 | Eder . | |

FOREIGN PATENT DOCUMENTS

| | | | |
|---|---|---|---|
| 1394222 | 2/1965 | France | 248/676 |
| 403677 | 6/1966 | Switzerland | 248/165 |
| 2206069 | 12/1988 | United Kingdom | 72/149 |

*Primary Examiner*—Daniel C. Crane

*Attorney, Agent, or Firm*—Barnes, Kisselle, Raisch, Choate, Whittemore & Hulbert, P.C.

[57] ABSTRACT

A sheet bending brake and stabilizing assembly wherein the sheet bending brake alone is constructed and arranged such that when a workpiece is clamped for bending when a person stands on the floor facing the handle means and the handle means is grasped and raised in a direction away from the person in order to move the handle means and raise the handles means, forces occur which prevent the handle means from moving sufficiently to produce a predetermined bend and the forces causes the entire sheet bending brake to tip away from the person about the portions of the legs which project outwardly from said bending brake and thus prevent the movement of the bending member relative to the first member and prevent bending of the workpiece. The stabilizing assembly for counteracting such forces on the sheet bending brake comprises transversely spaced rails receiving at least a portion of the ends of the leg assemblies. The transversely spaced rails which receive at least a portion of the leg assemblies have portions extend outwardly from beneath the sheet bending brake beyond the brake toward the side of the brake from which the handle member and handle means are accessible. Longitudinally extending rail interconnect the transverse rails. The longitudinally extending rail is attached to the portions. The weight and positioning of the sheet bending brake, leg assemblies and rails are such that a person standing on the floor and facing the side of the brake, grasping and raising the handle means at desired bend without tipping.

29 Claims, 7 Drawing Sheets

HEAVY DUTY SHEET BENDING BRAKE

This invention is a continuation-in-part of application Ser. No. 08/268,808 filed Jun. 30, 1994, now U.S. Pat. No. 5,582,055 which is continuation of application Ser. No. 07/987,249 filed Dec. 7, 1992 now U.S. Pat. No. 5,343,728, which is a continuation of application Ser. No. 07/798,207 filed Nov. 26, 1991, abandoned.

This invention relates to sheet bending brakes.

BACKGROUND AND SUMMARY OF THE INVENTION

In recent years, various structures have been provided to form a portable sheet bending brake for bending metal or plastic sheets such as are used in siding on homes and buildings. Typical patents comprise U.S. Pat. Nos. 3,161,223, 3,481,173, 3,482,427, 3,559,444, 3,817,075, 3,872,755 and 4,321,817.

Such brakes comprise a fixed member on which the sheet is clamped and a movable bending member for bending the sheet. A major problem with respect to such sheet bending brakes is the tendency of the bending member to move relative to the portion of the sheet being bent and thereby mar the surface of the sheet.

In U.S. Pat. No. 3,161,233, the tendency to mar the surface of the sheet material was minimized by having the intermeshing integral projection between the fixed member and bending member which extend longitudinally and define the hinge that connects the bending member with the fixed member having the clamping surfaced, positioned so that all portions of the projections do not extend above the plane of the surface of the members when the surfaces are substantially aligned.

U.S. Pat. Nos. 3,481,174 and 3,482,427 were directed to an arrangement which included a floatable compensator on the bending member which engages the sheet material and as the bending member is swung to bend the sheet pivots so that the contact with the sheet material is maintained.

Accordingly among the objectives of the present invention and are to provide a sheet metal bending brake which is relatively light in weight, portable and less costly and a stabilizing assembly to prevent the brake from tipping when a workpiece of thicker cross section is bent.

In accordance with the invention, there has been provided a sheet bending brake and stabilizing assembly wherein the sheet bending brake alone is constructed and arranged such that when a workpiece is clamped for bending when a person stands on the floor facing the handle means and the handle means is grasped and raised in a direction away from the person in order to move the handle means and raise the handle means, forces occur which prevent the handle means from moving sufficiently to produce a predetermined bend and the forces cause the entire sheet bending brake to tip away from the person about the portions of the legs which project outwardly from the bending brake and thus prevent the movement of the bending member relative to the first member and prevent bending of the workpiece. The stabilizing assembly for counteracting such forces on the sheet bending brake comprises transversely spaced rails receiving at least a portion of the ends of the leg assemblies. The transversely spaced rails which receive at least a portion of the leg assemblies have portions extend outwardly from beneath the sheet bending brake beyond the brake toward the side of the brake from which the handle member and handle means are accessible. Longitudinally extending rail means interconnecting the transverse rails. The longitudinally extending rail is attached to the portions. The weight and positioning of the sheet bending brake, leg assemblies and rail are such that a person standing on the floor and facing the side of the brake, grasping and raising the handle means, forces opposing bending are not counteracted and the bending can not be achieved and such that the person must place one foot or both feet on the longitudinally extending rail means during the movement of the bending member away from the person for performing the bending to a desired bend without tipping of the bending brake away from the person and permit movement of the bending member relative to the first member to bend the workpiece.

DESCRIPTION

Figure 1:
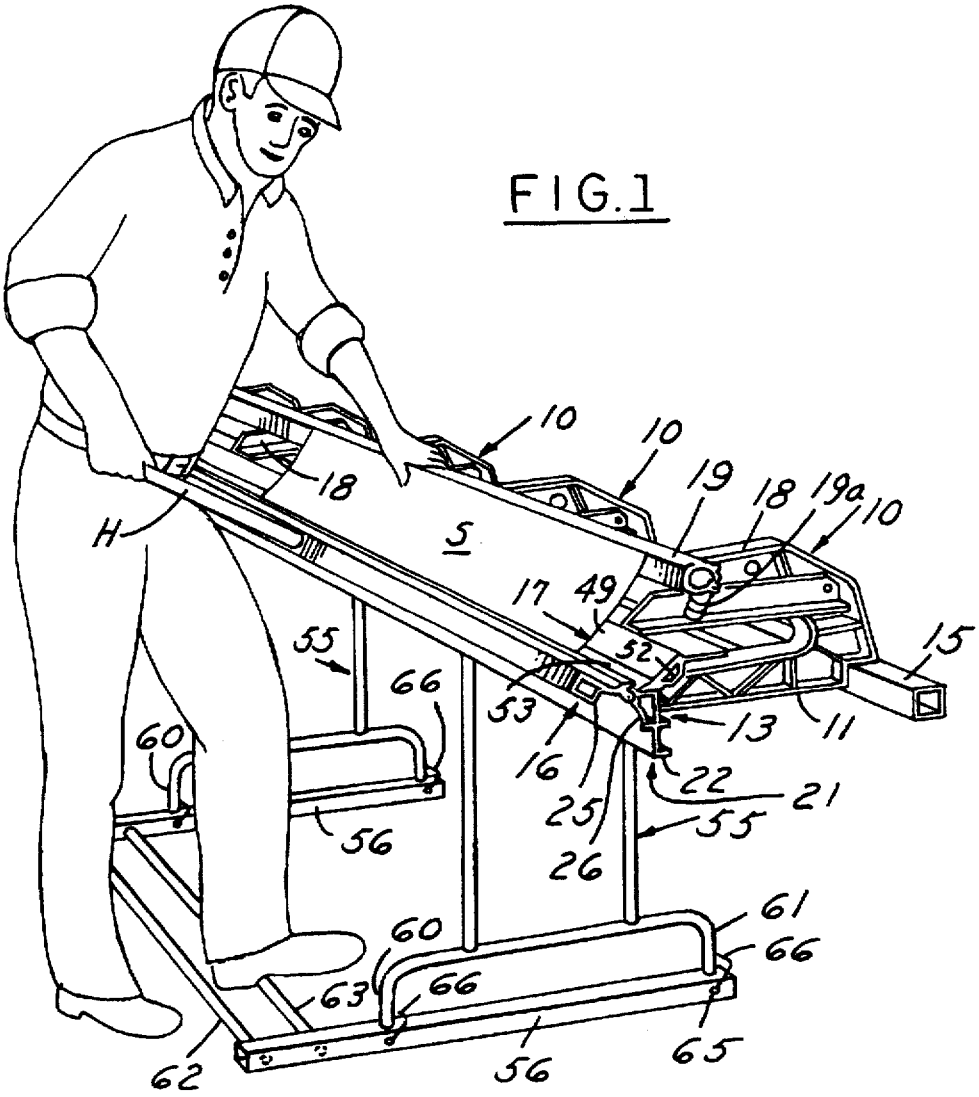
FIG. 1 is a perspective view of a sheet bending brake embodying the invention.
Figure 3:
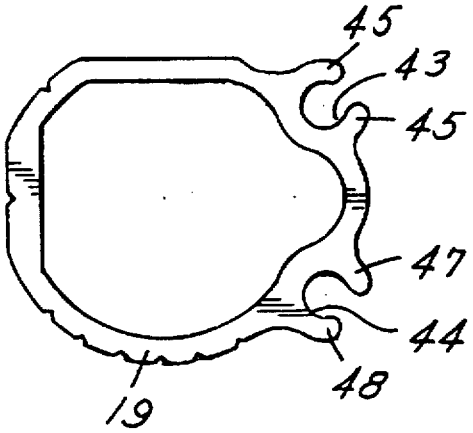
FIG. 3 is a fragmentary vertical section view of a handle member utilized in the sheet bending brake.

Referring to FIGS. 1–4, the sheet bending brake embodying the invention comprises longitudinally spaced C-shaped frame members 10. Each frame member includes a lower arm 11 and an upper arm 12 which overlies the lower arm 11 in spaced relation thereto. Legs may be provided as needed to support the brake above the floor or working area.

A first fixed member 13 is fixed on the ends of the free lower arms 11 and defines a clamping surface 14. A longitudinally spaced base rail 15 is fixed to the rear end of the lower arms 11. A second bending member 16 is hinged to the first member 13, as presently described, to provide a means for bending the sheet material.

Clamping anvil member 17 extends longitudinally in overlying relationship to the clamping surface 14 of the first member 13. Means are provided for moving the anvil member toward and away from the clamping surface to clamp a workpiece on the clamping surface. The means for clamping the workpiece may comprise any of the structures set forth in the aforementioned United States patents, incorporated herein by reference, but as herein shown comprise channel shaped pivot bars 18 pivoted on each frame member 10 with the clamping member 17 fixed thereto and a handle member 19 pivoted to the upper arm 12 of each C-frame member 10 and to the pivot bars 18 by a plurality of extensible links 19a pivoted at the upper edge to the handle member 19 and at the lower end to the pivot bars 18. The extensible links 19a may be of the type shown in U.S. Pat. No. 4,766,757, incorporated herein by reference.

In accordance with the invention, the first member 13 having the clamping surface 14 is formed as an aluminum extrusion and includes an upper tubular portion 20 and a lower portion 21 including spaced flanges 22 engaging the free ends of lower arms 11. A plurality of longitudinally spaced projections 23 are provided at the juncture of the portion 20 which defines the clamping surface 14. Each projection 23 has a slot 24 formed therein and the slots 24 of the various projections 23 are in longitudinal alignment. Each slot 24 has its lower ends spaced from the clamping surface A and extends outwardly and upwardly so that its upper end is generally near the plane of the clamping surface. Each slot 24 is preferably arcuate and has a center spaced from the clamping surface and preferably extends for substantially 90 degrees.

The bending member 16 is also in the form of an extrusion including a tubular portion 25 and a longitudinally extending leg 26 with a plurality of longitudinally spaced projections 27 having openings 28 therein. The projections 27 of the bending member 16 mesh with the projections 23 of the fixed member 13 and a pin 29 extends through the openings 28 and slots 24 to hinge the bending member 16 to the fixed member 13. The bending member 16 further includes a portion 30 that extends upwardly and outwardly when the bending member 16 is in position for bending and has a contacting portion defined by a longitudinally extending plastic strip 31 positioned in a recess 32. The recess is generally L-shaped and the strip 31 includes a short leg 33 having an enlarged end portion 34 for holding the strip 31 and the other leg 35 thereof extends along the recess beyond the portion to define a sheet contacting portion. Strip is preferably made of polyurethane having a durometer of 60 on the A scale.

The fixed member 13 further includes a recess 36 extending longitudinally at the juncture of the clamping surface 14 and the projections 23. Recess 36 functions as a pocket into which any burrs may fall from a knife used for scoring the workpiece. The clamping surface 14 is spaced slightly above the projections 23 in order to minimize marring of the surface of the workpiece when it is inserted and removed.

The bending member 16 also includes a recess 37 extending longitudinally between the projections 27 and the contacting portion 31.

In use, a workpiece of sheet material is clamped against the clamping surface 14 and the bending member 16 is moved by swinging the handle bringing the contacting portion of the bending member 16 in engagement with the sheet material. As the bending member is swung upwardly, the hinge pin 29 on the bending member 16 moves along the slots 24 and is guided in a fashion such that the contacting portion maintains substantially the same relative position of contact thereby minimizing marring of the surface of sheet material.

Figure 2:
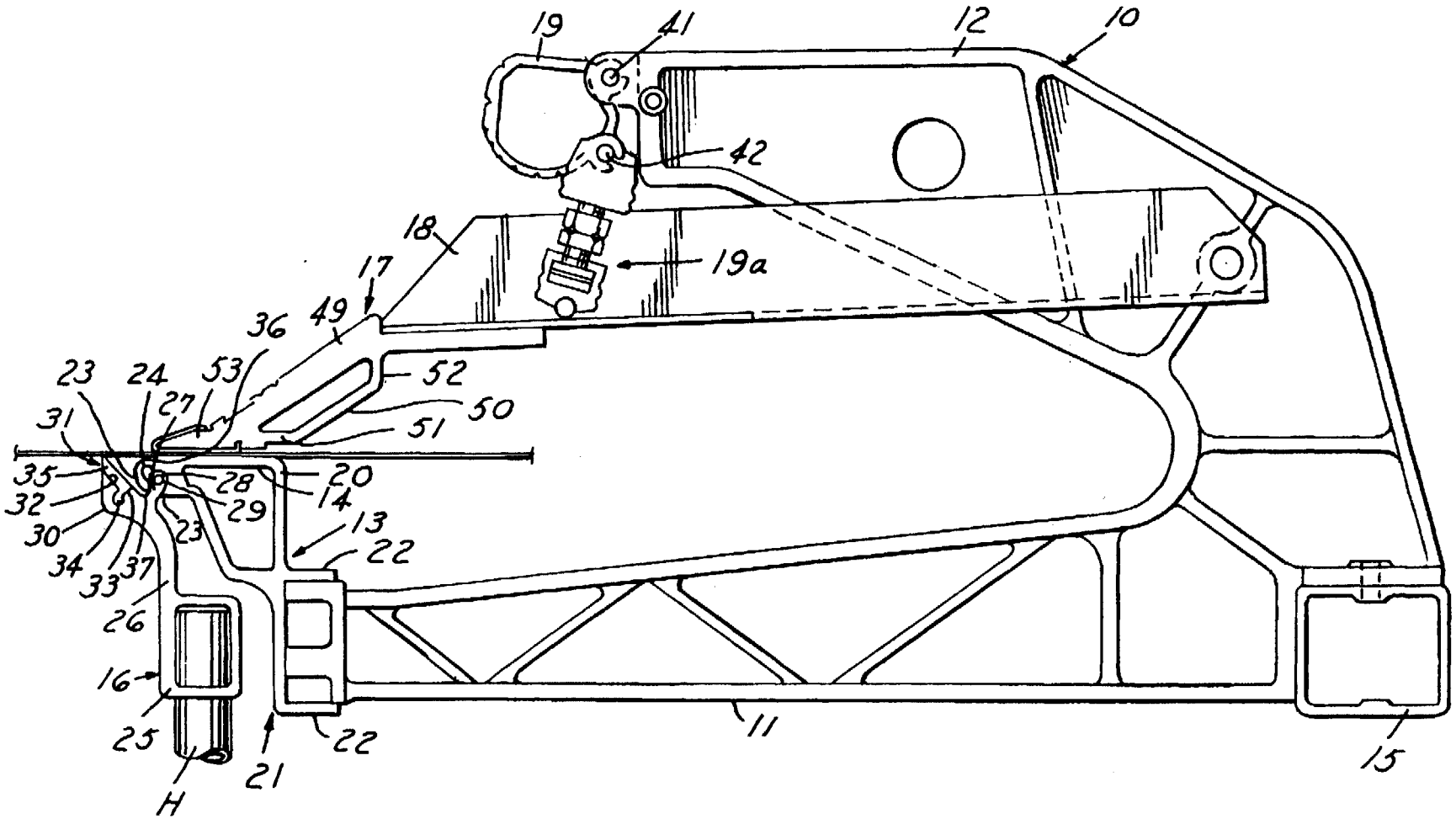
FIG. 2 is a vertical sectional view of the sheet bending brake.
Figure 4:
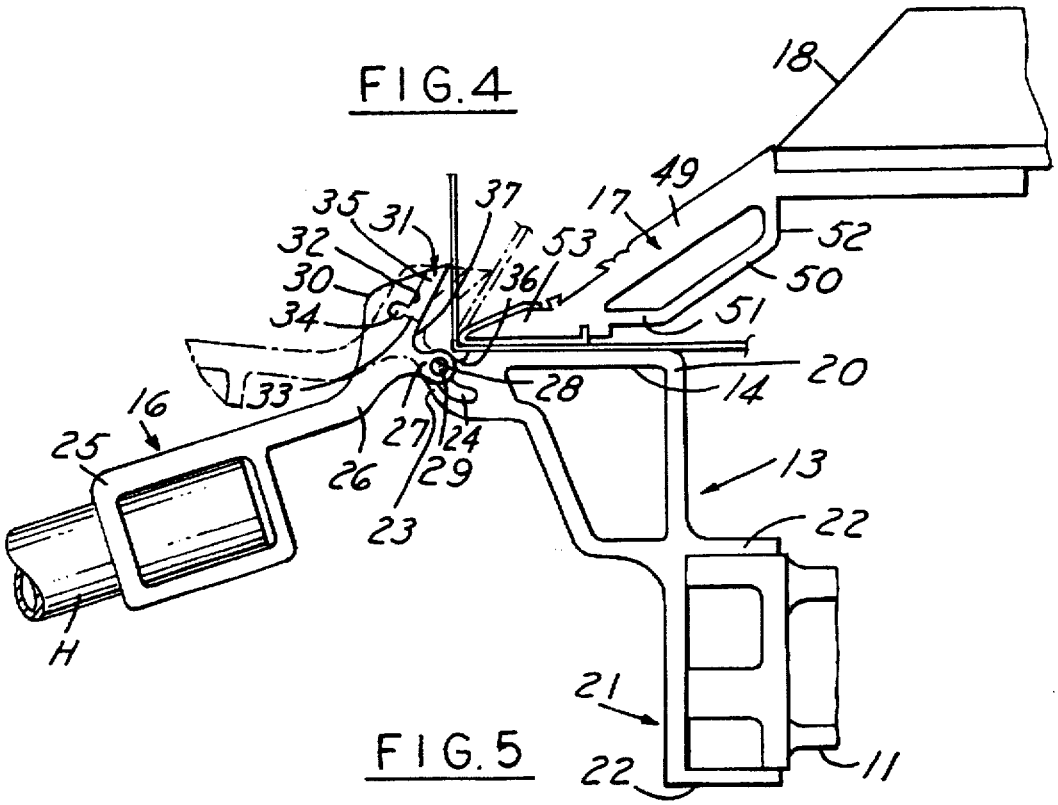
FIG. 4 is a fragmentary sectional view showing the parts in a different operative position.
Figure 5:
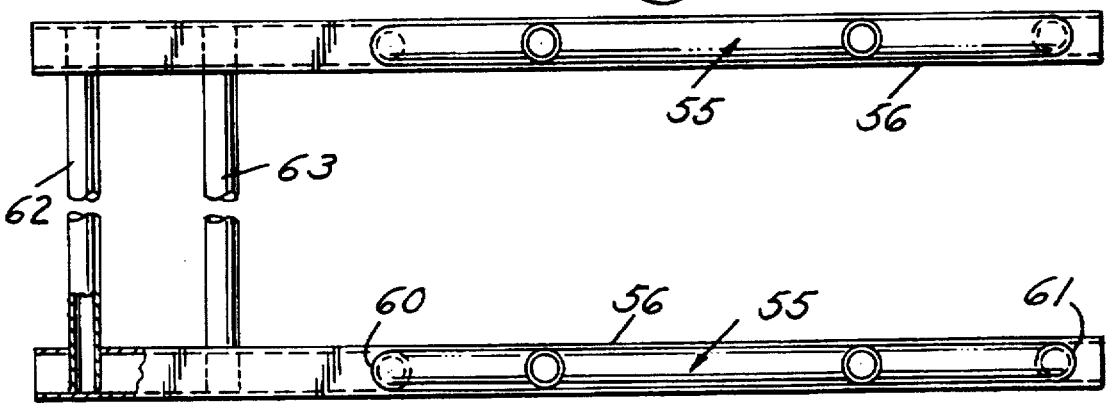
FIG. 5 is a plan view of a stabilizing assembly.
Figure 6:
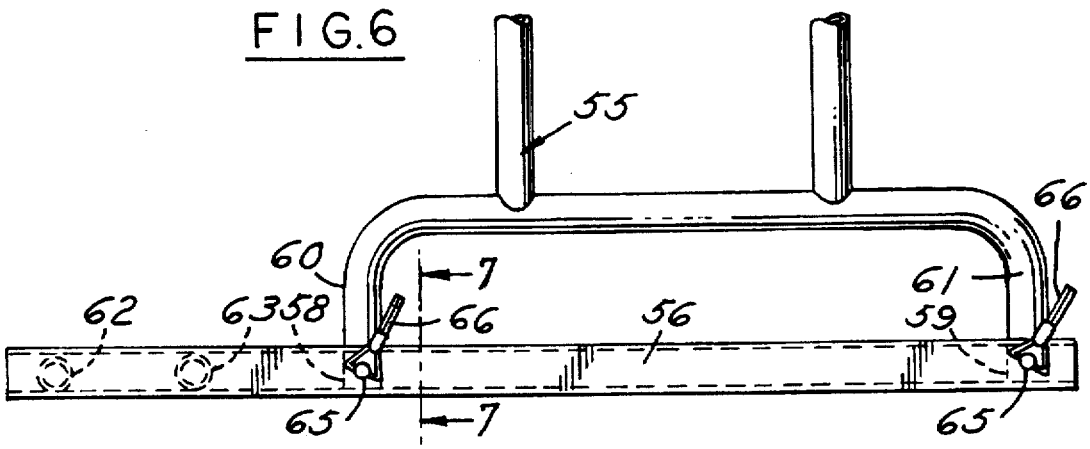
FIG. 6 is a fragmentary elevational view thereof.

As shown in FIGS. 2 and 4, the arcuate slots 24 extend generally from below the nose or bending edge of the clamping member upwardly and outwardly toward the user so that the hinge pin 16 moves along slots 24 as the workpiece is being bent until the hinge pin 29 reaches the upper end of the slots 24 (FIG. 6) after which the bending member 16 can be moved further to bend the workpiece into contact with the upper inclined surface of the clamping member 17.

The aforementioned described construction is substantially as shown in U.S. Pat. No. 4,557,132, incorporated herein by reference.

In accordance with the invention, in order to provide for bending of thicker sheet metal, certain modifications in the construction have been utilized which cooperate to produce a sheet metal bending brake which will effectively bend such sheet metal even though the sheet bending brake is not heavy and relatively portable. It has heretofore been thought to be impossible to provide a portable sheet metal bending brake that will readily bend sheet metal of increased thickness and hardness.

In accordance with the invention, the handle member 19 which is connected to the members 10 by pins 41 and to the links 19 by pins 2 is provided with recesses 43, 44 defined by integral portions 45, 46, 47 and 48, respectively, that are positioned so that the recesses 43, 44 lie substantially in the circle of the body of metal of the hollow handle member 19 thereby improving substantially the strength of the handle member.

In addition, the anvil or clamping member 17 is formed so that it has a tubular cross section including a heavy upper wall 49 and a lighter lower wall 50 generally parallel to the wall 49 and connected thereto by integral inclined portions 51, 52. The tubular portion extends rearwardly from the clamping portion 53. It has been found that such a construction contributes substantially to the strength of the sheet bending brake and the resultant ability to bend relatively thick sheet metal.

Figure 7:
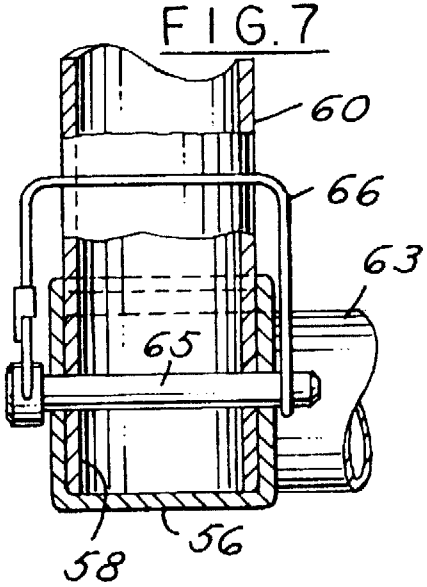
FIG. 7 is a sectional view taken along the line 7—7 in FIG. 6.

Further, in accordance with the invention, a stabilizing assembly is added to the legs 55 which may be fixed or folded and attached to the members 13 and 15. The stabilizing assembly comprises spaced tubular transverse rails 56 which are preferably rectangular in cross section having openings 58, 59 for receiving the feet 60, 61 of the legs 55. Longitudinally extending hollow rails 62, 63 are fixed to extend lengthwise of the brake between the rails 56. The feet 60, 61 are preferably locked to the rails 56 by a pin 65 extending through the feet 60, 61 and the rails 56, 57. The pin 65 is retained by a clip 66 that is hinged to the head of the pin 65 and releasably connected to the free end of the pin 65 as shown in FIG. 7.

In use, as shown in FIG. 1, a person utilizing the sheet bending brake inserts the sheet and clamps it in position by manipulating the handle 19. The person further places one or both feet on one or both of the rails 62, 63 and simultaneously lifts the bending member 16 by means of one or more handles H. Where the length of the brake is on the order of ten feet or more and the sheet being bent is more, two person of less stature may manipulate the brake by each person grasping a handle and placing one or both feet on the rails of the stabilizing assembly.

It has been found that by the use of such a stabilizing assembly, the force opposing the movement the bending member 16 is counteracted and the bending is facilitated.

It has been found that a sheet bending brake embodying the invention is portable and yet permits bending of the sheet material which has a thickness substantially more than that heretofore thought possible.

In tests conducted to date, it has been found that the sheet material can be readily bent. The results are summarized in the following table:

TABLE

| | GAUGE | THICKNESS | ALLOY | 90 BEND | 180 BEND | TEMPER HARDNESS |
|---|---|---|---|---|---|---|
| ALUM. COIL | | .050 | 1100 | X | X | 0 thru H14 |
| | | .0453 | 3003 | X | X | 0 thru H14 |
| | | .0453 | 5005 | X | X | 0 thru H14 |
| | | .0453 | 5052 | X | X | 0 |
| ALUM. SHEET | | .032 | 6061 | X | | T4/T6 |
| | | .040 | 1100 | X | X | 0 thru H14 |
| | | .040 | 3003 | X | X | 0 thru H14 |
| | | .040 | 5005 | X | X | 0 thru H14 |
| | | .040 | 5052 | X | X | 0 thru H14 |
| | | .040 | 6061 | X | X | 0 |
| COLD ROLLED STEEL SHEET COIL COMMERCIAL QUALITY | 21 ga. | .0329 | low carbon | X | X | ASTM/A366 |
| HOT ROLLED STEEL SHEET & COIL DRAWING QUALITY | 20 ga. | .0359 | | X | X | ASTM/A620 |
| GALV. STEEL SHEET & COIL | 20 ga. | .040 | | X | | ASTM 526 |
| | 20 ga. | .040 | | | | ASTM 527 |
| | 24 ga. | .028 | | X | X | ASTM 527 |
| SOFT COPPER SHEET | 20 oz. | .0324 | soft | X | X | ASTM B-152 |
| COLD ROLLED ANNEALED COPPER ROLL | 24 oz. | .0324 | soft | X | X | ASTM B-152 |
| COLD ROLLED COPPER SHEET | 24 oz. | .0324 | ⅛ to ¼ hard | X | | ASTM B-152 |
| | 16 oz. | .0216 | ⅛ to ¼ | X | | ASTM B-152 |
| STAINLESS SHEET & COIL | 24 ga. | .0324 | type 304 & 3041 | X | | ½HARD |
| | 24 ga. | .0324 | 316 | X | | ¼HARD |
| BRASS SHEET & COIL | 20 ga. | .0320 | CDA260 | X | X | ½HARD |

MATERIAL BENDING CAPABILITIES

| MATERIAL | WINDY | SUPER | WINDY HD | SUPER HD | ULTRA XL PRO T.S. | PRO HD |
|---|---|---|---|---|---|---|
| Soft Alum. | .030 | .030 | .035 | .035 | .030 | .035 |
| Hard Alum. | .022 | .022 | .025 | .025 | .022 | .025 |
| Galv. Steel | 29 ga | 29 ga | 26 ga | 26 ga | 29 ga | 26 ga |
| Copper | | | 16 oz | 16 oz | 16 oz | 16 oz |
| Vinyl | ALL STANDARD VINYL SIDINGS | | | | | |

Figure 9:
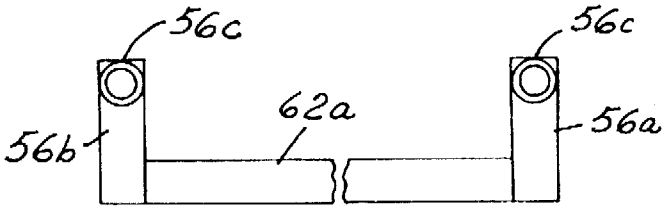
FIG. 9 is a fragmentary plan view of a portion of the sheet bending brake set forth in FIG. 8.
Figure 8:
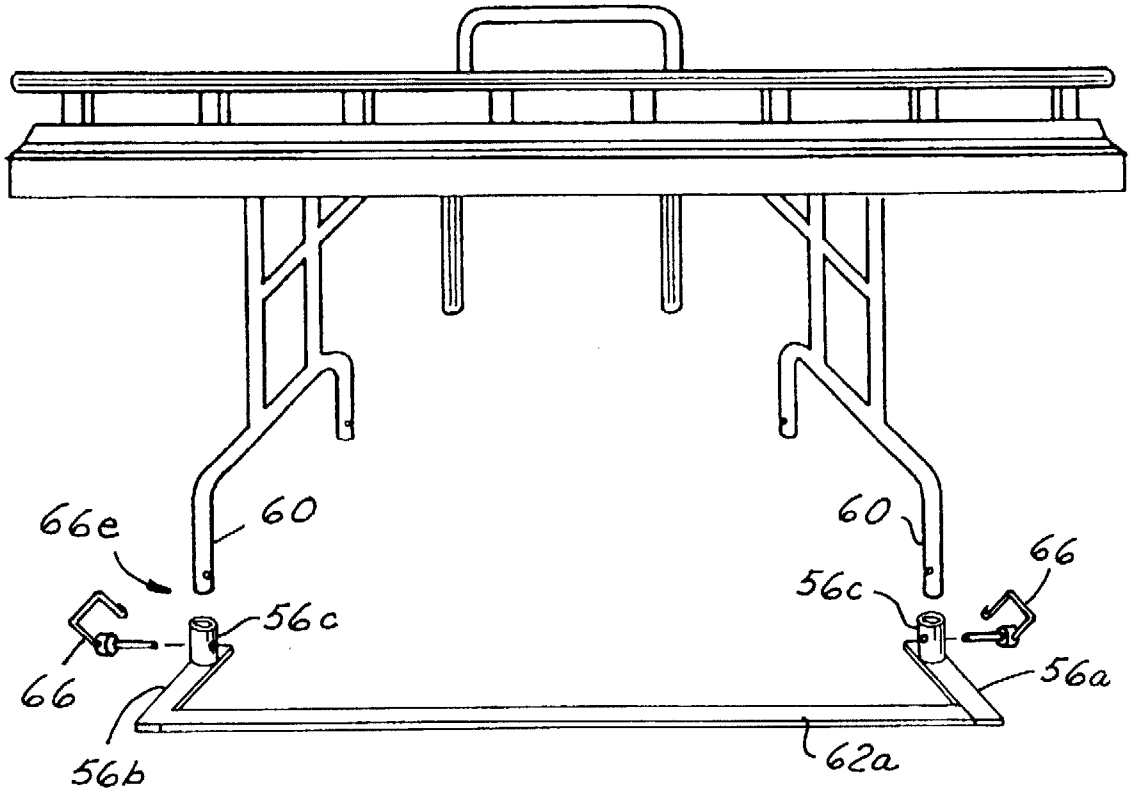
FIG. 8 is an exploded view of another modified from of sheet bending brake and stabilizing assembly.

In the form shown in FIGS. 8 and 9, the stabilizing assembly comprises a flat metal transverse rail 56*a* and a flat metal longitudinal rail 62*a* rigidly attached to rail 56*a*. An upstanding tubular portion 56*c* is fixed on the end of transverse rail 56*b* and receives the foot 60 of the legs nearest the user. A bolt or lock pin 66*e* attaches each foot 60 and tubular portions 56*c*.

Figure 10:
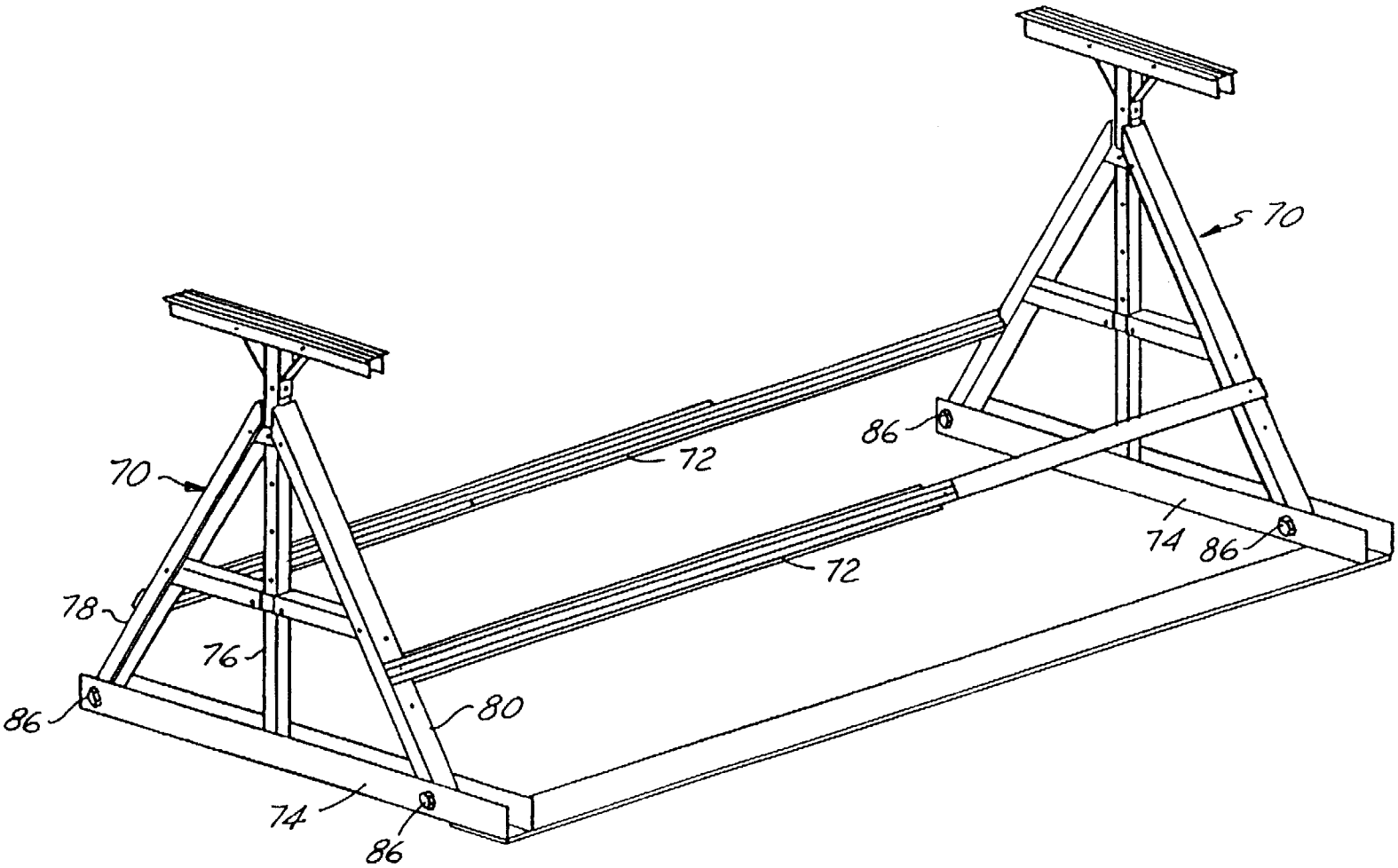
FIG. 10 is a perspective view of a another form of stabilizing assembly for use with a sheet bending brake.
Figure 11:
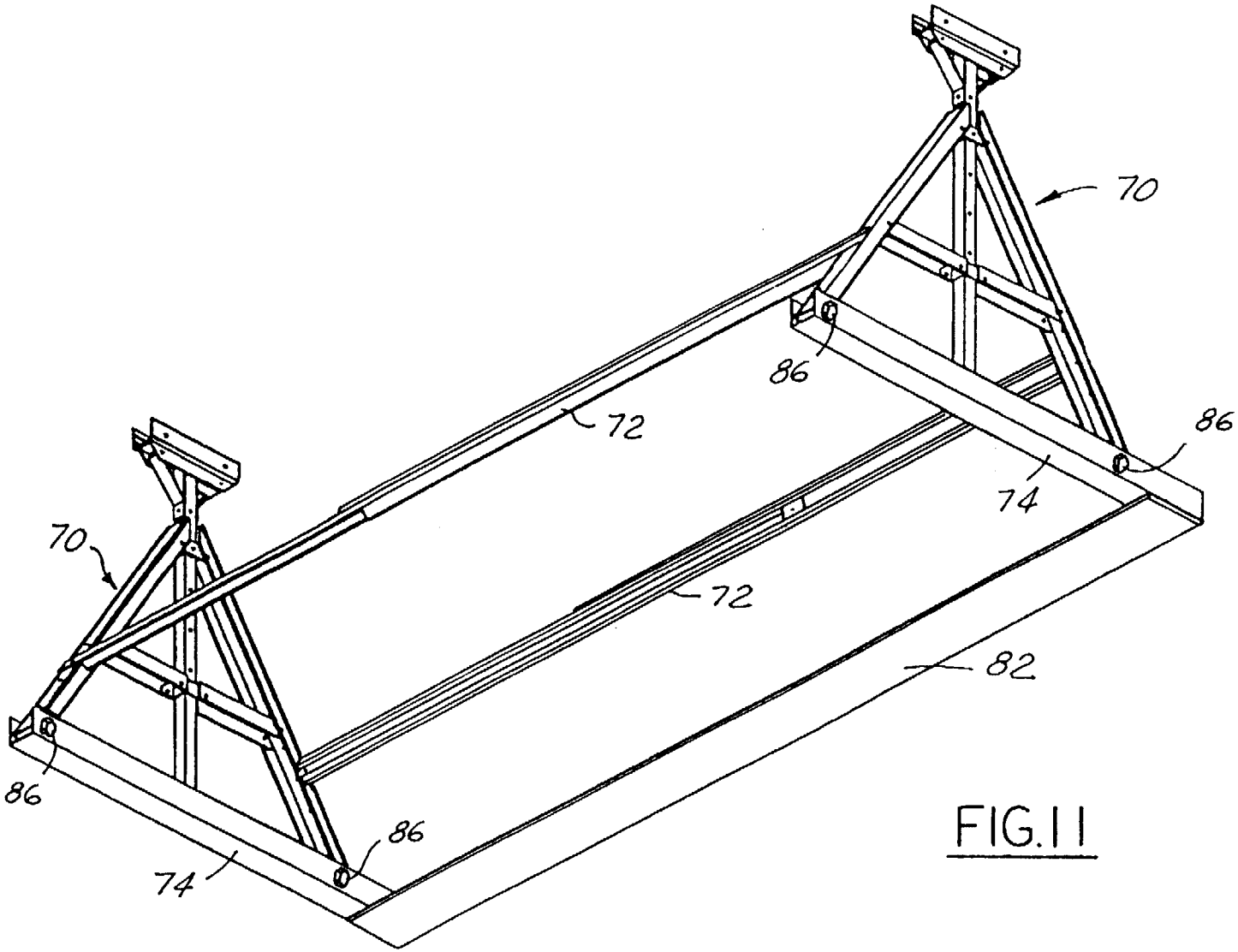
FIG. 11 is a bottom perspective view of the stabilizing assembly shown n FIG. 10.

In the form shown in FIGS. 10 and 11, the sheet bending brake is supported on triangular folding leg assemblies 70 interconnected by longitudinal members 72. The legs assemblies 70 are foldable as more specifically defined in copending application Ser. No. 08/484,977 filed Jun. 7, 1995, now U.S. Pat. No. 5,651,298 incorporated herein by reference. The stabilizing assembly comprises transverse rails 74 that are U shaped in cross section and receive the legs 76, 78, 80 of the leg assemblies 70. The stabilizing assembly further includes a flat metal longitudinally extending rail 82 rigidly attached to the underside of the transverse rails 74. The legs 76, 78, 80 are attached to the upstanding walls 84 of transverse rails 74 by lock pins 86 or bolts.

Figure 12:
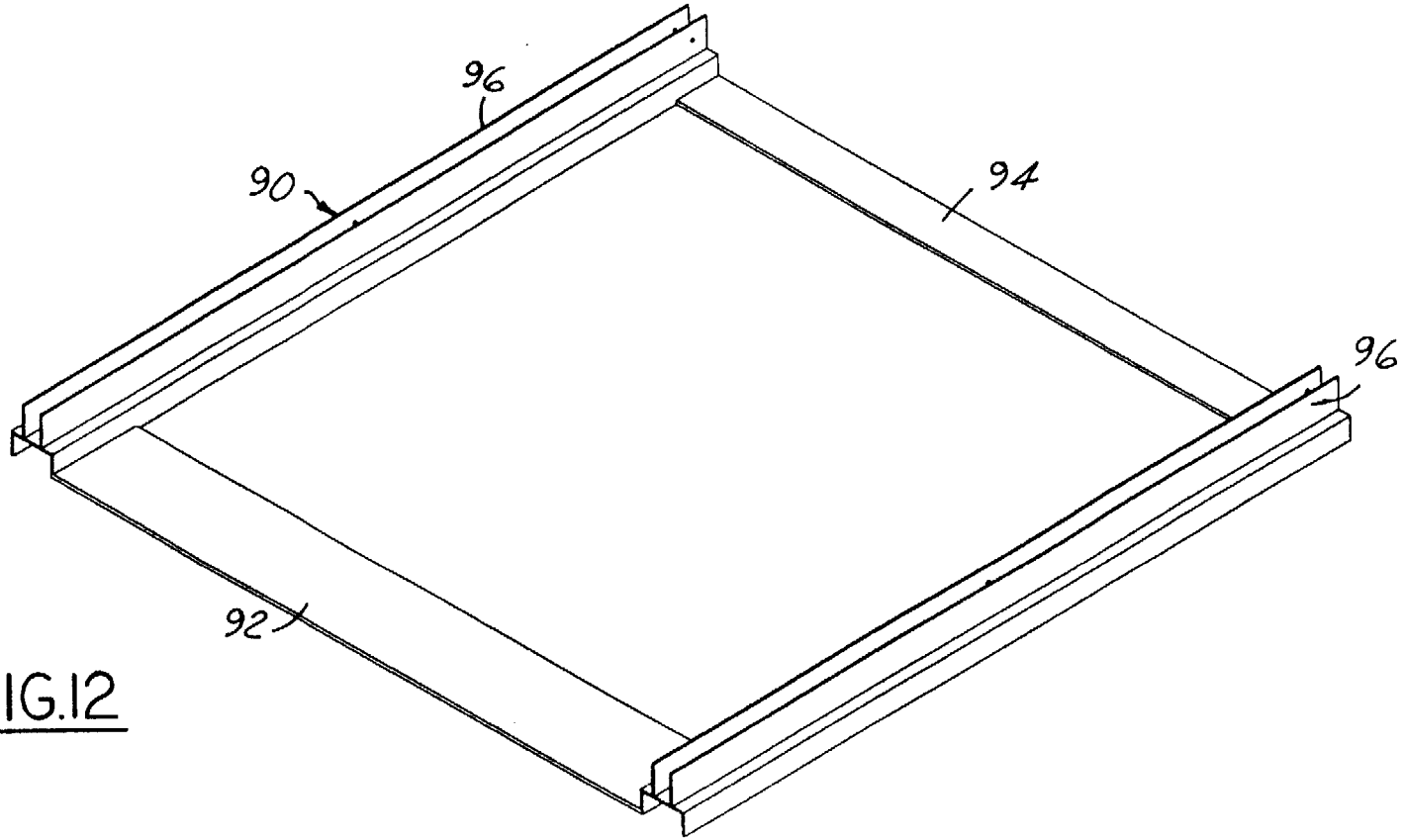
FIG. 12 is a perspective view of a modified form of stabilizing assembly.
Figure 13:
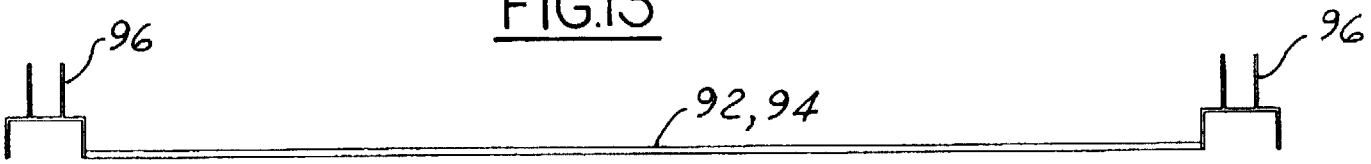
FIG. 13 is an end view of the stabilizing assembly shown in FIG. 12.

In the form shown in FIGS. 12 and 13, the stabilizing assembly comprises a unitary construction of metal or plastic including transverse rails 90 rigidly connected to a flat longitudinal rail 92 at the forward end of the transverse rails 90 and a rear transverse rail 94. Each transverse rail is U-shaped in cross section as at 96. The legs of the sheet bending brake are received in the U-shaped portion at the rear of the transverse rails 92 at the juncture with rear rail 94 and are rigidly connected thereto by suitable means such as pins or clips.

It can thus be seen that there has been provided a sheet bending brake and stabilizing assembly wherein the sheet bending brake alone is constructed and arranged such that when a workpiece of increased thickness is clamped for bending when a person stands on the floor facing the handle means and the handles means is grasped and raised in a direction away from the person in order to move the handle means and raise the handle means, forces occur which prevent the handle means from moving sufficiently to produce a predetermined bend and the forces cause the entire sheet bending brake to tip away from the person about the portions of the legs which project outwardly from said bending brake which prevent the movement of the bending member relative to the first member and prevent bending of the workpiece. The stabilizing assembly for counteracting such forces on the sheet bending brake comprises transversely spaced rails receiving at least a portion of the ends of leg assemblies. The transversely spaced rails which receive at least a portion of said leg assemblies having portions extend outwardly from beneath the sheet bending brake beyond the brake toward the side of the brake from which said handle member and handle means are accessible. Longitudinally extending rail means interconnecting the transverse rails. The longitudinally extending rail are attached to said portions. The weight and positioning of the sheet bending brake, leg assemblies and rail are such that in the absence of said stabilizing assembly when bending thicker metal by a person standing on the floor and facing the side of the brake, grasping and raising the handle means, the forces opposing bending are not counteracted and the bending can not be achieved and such that the person must place one foot or both feet on the longitudinally extending rail means during the movement of the bending member away from the person for performing the bending to a desired bend without tipping of the bending brake away from the person and permit movement of the bending member relative to the first member to bend the workpiece.

We claim:

1. A portable sheet bending brake comprising a first longitudinally extending clamping member having a clamping surface, clamping means movable toward and away from the clamping surface for holding a workpiece in position for bending, a handle member attached to said clamping member, a second bending member for bending a workpiece clamped on said clamping surface extending longitudinally with respect to said first member, means hinging said second bending member to said first member, handle means attached to said second bending member and normally extending downwardly such that when the clamping means is moved to hold a workpiece in position for bending, a person standing on the floor and facing the side of the brake having said bending member thereon grasps said handle means and raises said handle means in a direction away from the person and toward the clamping member to pivot said second bending member away from the person relative to the first member about said hinging means for bending a workpiece clamped on said clamping surface to produce a desired bend, leg assemblies extending downwardly from said sheet bending brake elevating said brake above the floor, said leg assemblies having portions projecting outwardly from beneath the sheet bending brake toward the side of the brake opposite to the side from which said handle member and handle means are accessible, said sheet bending brake being constructed and arranged such that when a workpiece of increased thickness is clamped for bending when a person stands on the floor facing the handle means and the handle means is grasped and raised in a direction away from the person in order to move the handle means and raise the handle means, forces occur which prevent the handle means from moving sufficiently to produce a predetermined bend and the forces cause the entire sheet bending brake to tip away from the person about the portions of the legs which project outwardly from said bending brake which prevent the movement of the bending member relative to the first member and prevent bending of the workpiece, a stabilizing assembly for counteracting such forces on said sheet bending brake comprising transversely spaced rails receiving at least a portion of said leg assemblies, said transversely spaced rails which receive at least a portion of said leg assemblies having portions extending outwardly from beneath the sheet bending brake beyond the brake toward the side of the brake from which said handle member and handle means are accessible, longitudinally extending rail means interconnecting said transverse rails, said longitudinally extending rail being attached to said portions, the weight and positioning of said sheet bending brake, legs and rail being such that in the absence of said stabilizing assembly when bending thicker metal by a person standing on the floor and facing the side of the brake, grasping and raising the handle means, the forces opposing bending are not counteracted and the bending can not be achieved and such that the person must place one foot or both feet on the longitudinally extending rail means during the movement of the bending member away from the person for performing the bending to a desired bend without tipping of the bending brake away from the person and permit movement of the bending member relative to the first member to bend the workpiece.

2. The sheet bending brake set forth in claim 1 wherein each said transverse rail is rectangular in cross section and includes an upwardly extending tubular portion receiving at least one leg of a leg assembly.

3. The sheet bending brake set forth in claim 1 wherein said longitudinally extending rail is rectangular in cross section.

4. The sheet bending brake set forth in claim 1 wherein each said transverse rail is rectangular in cross section and includes an upwardly extending tubular portion receiving at least one leg of a leg assembly, said longitudinally extending rail being rectangular in cross section, and each said transverse rail including a tubular portion receiving the ends of said longitudinally extending rail.

5. The sheet bending brake set forth in claim 1 wherein each said transverse rail and said longitudinal rail is flat and said transverse rail is rigidly attached to said longitudinal rail.

6. The sheet bending brake set forth in claim 5 wherein each said transverse rail includes an upwardly extending tubular portion receiving said leg portion of said leg assembly.

7. The sheet bending brake set forth in claim 1 wherein each said transverse rail is U-shaped in cross section and includes a base wall and upwardly extending walls receiving said portion of said leg assembly.

8. The sheet bending brake set forth in claim 7 wherein said longitudinally extending rail is flat in cross section and rigidly attached to said transverse rails.

9. The sheet bending brake set forth in anyone of claims 1–3 and 4–8 including means removably connecting said legs to said transversely spaced rails of said stabilizing assembly such that said sheet bending brake can be used without said stabilizing assembly to bend workpieces having lesser thicknesses.

10. A portable sheet bending brake comprising a base, a plurality of C-shaped members positioned on said base at longitudinally spaced points, each said C-shaped member comprising a lower arm fixed to said base and an upper arm spaced from and overlying said lower arm, a first member fixed to the lower arms of said C-shaped members and having a clamping surface, clamping means movable toward and away from said clamping surface for locking a piece of sheet material on said clamping surface, a handle member attached to said clamping means, a second member for bending a workpiece clamped on said clamping surface extending longitudinally with respect to said first member, means hinging said second member to said first member, handle means attached to said second member and normally extending downwardly such that when the clamping means is moved to hold a workpiece in position for bending, a person facing the side of the brake having said second member thereon grasps said handle means and raises said handle means in a direction away from the person and toward the clamping member to pivot said second member away from the person relative to the first member about said hinging means for bending a workpiece clamped on said clamping surface to produce a desired bend, leg assemblies extending downwardly from said sheet bending brake elevating said brake above the floor, said leg assemblies having portions projecting outwardly from beneath the sheet bending brake toward the side of the brake opposite to the side from which said handle member and handle means are accessible, said sheet bending brake being constructed and arranged such that when a workpiece of increased thickness is clamped for bending and when a person stands on the floor facing the handle means and the handle means is grasped and raised in a direction away from the person in order to move the handle means and raise the handle means, forces occur which prevent the handle means from moving sufficiently to produce a predetermined bend and the forces cause the entire sheet bending brake to tip away from the person about the portions of the legs which project outwardly from said bending brake and which prevent the movement of the bending member relative to the first member and prevent bending of the workpiece, a stabilizing assembly for counteracting such forces on said sheet bending brake comprising transversely spaced rails receiving at least a portion of said leg assemblies, and said transversely spaced rails which receive at least a portion of said leg assemblies having portions extending outwardly from beneath the sheet bending brake beyond the brake toward the side of the brake from which said handle member and handle means are accessible, longitudinally extending rail means interconnecting said transverse rails, said longitudinally extending rail being attached to said portions of said spaced rails, the weight and positioning of said sheet bending brake, legs and rail being such that in the absence of said stabilizing assembly when bending thicker metal by a person standing on the floor and facing the side of the brake hang the clamping and bending member thereon, grasping and raising the handle means, the forces opposing bending are not counteracted and the bending cannot be achieved and such that when the person simultaneously grasps the handle means, places one or both feet on the longitudinally extending rail means and raises the handle means in a direction away from the person and the second bending member relative to the first member while one or both feet are on the rail means, the person is able to move the handle means relative to the first member toward the clamping member and is able to bend the workpiece to produce a desired bend without tipping of the brake.

11. The sheet bending brake set forth in claim 10 wherein each said transverse rail is rectangular in cross section and includes an upwardly extending tubular portion receiving at least one leg of a leg assembly.

12. The sheet bending brake set forth in claim 10 wherein said longitudinally extending rail is rectangular in cross section.

13. The sheet bending brake set forth in claim 10 wherein each said transverse rail is rectangular in cross section and includes an upwardly extending tubular portion receiving at least one leg of a leg assembly, said longitudinally extending rail being rectangular in cross section, and each said transverse rail including a tubular portion receiving the ends of said longitudinally extending rail.

14. The sheet bending brake set forth in claim 10 wherein each said transverse rail and said longitudinal rail is flat and said transverse rail is rigidly attached to said longitudinal rail.

15. The sheet bending brake set forth in claim 14 wherein each said transverse rail includes an upwardly extending tubular portion receiving said leg portion of said leg assembly.

16. The sheet bending brake set forth in claim 10 wherein each said transverse rail is U-shaped in cross section and includes a base wall and upwardly extending walls receiving said portion of said leg assembly.

17. The sheet bending brake set forth in claim 16 wherein said longitudinally extending rail is flat in cross section and rigidly attached to said transverse rails.

18. The sheet bending brake set forth in claim 10 wherein said leg means comprise spaced feet and means connecting said feet and said longitudinally extending rail.

19. The sheet bending brake set forth in claim 18 including a second longitudinally extending rail extending between said transverse rails.

20. The sheet bending brake set forth in claim 16 wherein a plurality of longitudinally spaced pivot bars are pivoted to said C-shaped frame members, said clamping means comprising a longitudinally extending clamping member mounted on said pivot bars and movable therewith toward and away from the fixed member for clamping a workpiece of the fixed member, said handle member being pivoted to the upper arm of said C-shaped frame member, a plurality of links interposed between said handle member and said pivot bars.

21. The sheet bending brake set forth in claim 20 wherein each of said first and second members having substantially the entire length of the longitudinal edges thereof formed with longitudinally spaced intermeshing integral projections, the projections on said first member having a plurality of aligned openings comprising slots extending axially with respect to the longitudinal axis of said member.

22. The sheet bending brake set forth in any one of claims 10–12 and 13–21 including means removably connecting said legs to said transversely spaced rails of said stabilizing assembly such that said sheet bending brake can be used without said stabilizing assembly to bend workpieces having lesser thicknesses.

23. In a portable sheet bending brake comprising a base, a plurality of C-shaped members positioned on said base at longitudinally spaced points, each said C-shaped member comprising a lower arm fixed to said base and an upper arm spaced from and overlying said lower arm, a first member fixed to the lower arms of said C-shaped member and having a clamping surface, clamping means movable toward and away from said clamping surface for locking a piece of sheet material on said clamping surface, a handle member attached to said clamping member, a second member for bending a workpiece clamped on said clamping surface extending longitudinally with respect to said first member, means hinging said second member to said first member, handle means attached to said second member and normally extending downwardly such that when the clamping means is moved to hold a workpiece in position for bending by a person standing on the floor and facing the side of the bending brake having said bending member and clamping member thereon grasps said handle means and raises said handle means in a direction away from the person to pivot said second bending member away from the person relative to the first member about said hinging means for bending a workpiece clamped on said clamping surface to produce a desired bend, leg means extending downwardly from said sheet bending brake elevating said brake above the floor, said leg means having portions projecting outwardly from beneath the sheet bending brake toward the side of the brake opposite to the side from which said handle member and handle means are accessible, said sheet bending brake being constructed and arranged such that when a workpiece of increase thickness is clamped for bending and when a person stands on the floor facing the handle means and the handle means is grasped and raised, forces occur which prevent the handle means from moving sufficiently to produce a predetermined bend and the forces cause the entire sheet bending brake to tip away from the person about the portions of the legs which project outwardly from said bending brake and which prevent the movement of the bending member relative to the first member and prevent bending of the workpiece, the method of stabilizing said sheet bending brake to permit bending a workpiece of increased thickness comprising providing transversely spaced rails receiving said portions of said leg means, providing said transversely spaced rails which receive said portions of said leg means with portions extending outwardly from beneath the sheet bending brake beyond the brake toward the side of the brake from which said handle member and handle means are accessible, providing longitudinally extending rail means interconnecting said transverse rails, attaching said longitudinally extending rail to said portions which extends outwardly of the brake toward the side of the brake which a person grasps the handle means, standing on the floor facing the side of brake having the clamping member and bending member thereon, simultaneously grasping said handle means and placing one or both feet on the longitudinally extending rail means, and raising the handle means in a direction away from the person and the second bending member relative to the first member while one or both feet are on the rail means to bend said thicker workpiece to raise the handle means to move the bending member relative to the first member to form the desired bend without tipping of the brake.

24. The method set forth in claim 23 wherein said step of providing each said transverse rail comprises providing a transverse rail which is rectangular in cross section and includes an upwardly extending tubular portion receiving at least one leg of a leg assembly.

25. The method set forth in claim 23 wherein said step of providing said longitudinally extending rail comprises providing a longitudinally extending rail which is rectangular in cross section.

26. The method set forth in claim 24 wherein said step of providing each said transverse rail comprises providing a transverse rail which is rectangular in cross section and includes an upwardly extending tubular portion receiving at least one leg of a leg assembly, said step of providing said longitudinally extending rail comprising providing a longitudinally extending rail which is rectangular in cross section, said step of providing each said transverse rail comprising providing each said transverse rail with a tubular portion receiving the ends of said longitudinally extending rail.

27. The method set forth in claim 23 includes providing said transverse rail and said longitudinal rail such that they are flat and said transverse rail is rigidly attached to said longitudinal rail.

28. The method set forth in claim 27 includes providing each said transverse rail with an upwardly extending tubular portion receiving said leg portion of said leg assembly.

29. The method set forth in claim 23 wherein said step of providing each said transverse rail such that the transverse rail is U-shaped in cross section and includes a base wall and upwardly extending walls receiving said portion of said leg assembly.

* * * * *